US006976602B1

(12) United States Patent
Maxwell

(10) Patent No.: US 6,976,602 B1
(45) Date of Patent: Dec. 20, 2005

(54) FOLDABLE INSULATED FOOD BOX

(76) Inventor: James R. Maxwell, 902 N. University Blvd., Norman, OK (US) 73069

( * ) Notice: Subject to any disclaimer, the term of this patent is extended or adjusted under 35 U.S.C. 154(b) by 0 days.

(21) Appl. No.: 11/061,676

(22) Filed: Feb. 18, 2005

(51) Int. Cl.[7] ..... B65D 8/14
(52) U.S. Cl. ..... 220/6; 220/7; 220/4.21; 220/4.22; 229/942; 229/906
(58) Field of Search ..... 220/4.21, 4.22, 220/6, 7; 229/942, 906, 117.01

(56) References Cited

U.S. PATENT DOCUMENTS

| | | | | |
|---|---|---|---|---|
| 3,147,908 | A * | 9/1964 | Clemens | 206/512 |
| 4,226,358 | A * | 10/1980 | Ottow | 220/4.24 |
| 4,694,986 | A | 9/1987 | Chou | |
| 4,848,543 | A * | 7/1989 | Doboze | 206/551 |
| 5,110,038 | A | 5/1992 | Pantisano et al. | |
| 5,209,392 | A | 5/1993 | Anatro | |
| 5,273,206 | A | 12/1993 | Vassiliou | |
| 5,305,949 | A | 4/1994 | Linden | |
| 5,375,761 | A | 12/1994 | Sullivan | |
| 5,476,216 | A | 12/1995 | Robertella | |
| 6,112,928 | A * | 9/2000 | Black et al. | 220/6 |
| 6,206,277 | B1 * | 3/2001 | Correll | 229/101 |
| 6,223,980 | B1 * | 5/2001 | Guillin | 229/122.21 |
| 6,386,440 | B1 * | 5/2002 | Tulkoff | 229/120.32 |
| 2004/0144782 | A1 * | 7/2004 | Kinsella | 220/7 |
| 2005/0056642 | A1 * | 3/2005 | Lion | 220/4.22 |

OTHER PUBLICATIONS

EarthShell Packaging Foam Laminate Products—EarthShell Website, Jun. 23, 2003.
Customer Feedback—EarthShell Website, Jun. 23, 2003.
The New Styrofoam Ban—What It Means For You, Green News, Dec. 2004, #4, EERD, Ventura, CA.
Ladd, Brian, Desiging for the Environment, Not the Dump: A Key to Zero Waste, Disposables Made from Plants Instead of Plastics, Ecocycle Times, vol. 27, No. 1, 2003.
Cradle—To —Cradle: The Next Packaging Paradigm? Feb. 18, 2005.
Quirks & Quarks for Apr. 28, 2001, Feb. 18, 2005.

* cited by examiner

*Primary Examiner*—Stephen K. Cronin
*Assistant Examiner*—Eugene Lhymn
(74) *Attorney, Agent, or Firm*—James T. Robinson

(57) ABSTRACT

A lower receptacle section with a flat base and upwardly sloping side walls mates with an upper cover section a flat top and downwardly sloping side walls. A hinge connects portion of the lower section lip to a portion of the upper cover section lip. Integrally formed v-shaped ribs in the flat base and the flat top provide structural strength, and pre-formed creases (or fold lines) facilitate folding of the food box for disposal.

14 Claims, 7 Drawing Sheets

FOLDABLE INSULATED FOOD BOX

BACKGROUND

This invention relates to foldable boxes and, more particularly, to insulated boxes which allow for the enclosure and transportation of food, which may be easily disposed of by destructive folding, and which are environmentally safe (biodegradable). The food box may also be referred to herein as a container.

DISCUSSION

Humans played a major role in environmental pollution for many years, and now that the damage is clear we have started the cleanup process. People became accustomed to throwing things "away" and never realized where "away" was. Solid waste was thrown away into trash containers, dumped into landfills, compacted and covered with dirt. It was assumed that the garbage would break down and mix with the soil. However, over the years the garbage became a major problem. It wasn't breaking down and landfills were beginning to overflow. This overflow of garbage in the landfills can lead to the release of hazardous gases and can contribute to water pollution. The realization that our planet was fragile and our environment was in danger became apparent. Attempts to preserve the environment became a priority.

Reducing, re-using and recycling, are the three principal methods of attacking the problem of overflowing landfills.

Reducing, in the context of waste, means using less. A good example of reducing is to use cloth towels instead of paper ones. Re-using helps us find ways to use materials we would normally throw away such as cardboard, grocery and plastic bags. Recycling is a processing technique used so items can also be used again-crushing glass bottles to make new glass, turning paper back into pulp to make new paper, shredding plastics to make fillings for jackets, and mixing grass cuttings with food scraps for fertilizer are all good examples of this process.

Although many communities have instituted recycling, this approach requires a commitment to the four steps of a successful program: collecting, sorting, reclaiming and reusing. Paper, glass and aluminum top the list of commonly recycled materials. Paper is recycled by using water and chemicals to remove the ink to create pulp. Pulp is cleaned, processed into tiny fibers and made into paper again. Aluminum is ground into small chips, melted down and made into solid bars. As a result, new cans can be made. Glass is broken up into a form of broken glass called cullet. Cullet is then melted down and reused again and again.

Another approach, termed "Zero Waste," requires that products be made from renewable and recoverable materials, and emphasizes that throughout their life-cycles these products must not pose a threat to the workers who make them, to the consumers who buy and utilize them, and to future generations who will deal with the environmental impacts of their disposal, reuse, recycling, or composting. Zero Waste products and processes are not an idealistic dream; even today Zero Waste principles are being practiced. Examples include algae-based packaging foam and biodegradable single-use cutlery. These two everyday products could easily replace some of the plastic, single-use, and non-biodegradable items that fill our landfills and create unnecessary waste and pollution in their production.

Potato starch and limestone are being combined to produce a biodegradable quick-serve food containers such as bowls and plates. Cornstarch-based forks and spoons will easily break down in a compost pile into earth-friendly byproducts. The cutlery is made from a readily available renewable resource: corn.

Recent growth in food take-out and delivery has resulted in more portable food boxes and, simultaneously, created more garbage for landfills. Traditional food boxes, due to their large dimensions and high rigidity, present considerable difficulty with regard to disposal. The assembled box is relatively large when compared with an opening in a trash receptacle. Once deposited in the trash receptacle, the assembled food box occupies an inordinate amount of space, seriously reducing the remaining space in the trash receptacle for other garbage. In addition, the structural integrity of a traditional food box and the presence of food product make folding, cutting, or separating a traditional food box difficult.

Take-out food containers made of cardboard allow more rapid heat loss than insulated containers such as expanded polystyrene foam hinged containers. Moisture causes cardboard to weaken thereby making the cardboard food box unsuitable for use in microwave ovens. Cardboard boxes can harbor bacteria, paper dust, and cardboard shavings which pose possible health problems and affect the smell and taste of the food. Migration of odors through the cardboard also affect the taste of the food.

Applicant's foldable insulated food box invention addresses the problems related to both the quantity of garbage and also the character of the garbage. A heat-retaining food container includes creases in top and bottom sections which promote easy folding into quarters for compact disposal, thereby reducing the volume of the garbage. Compared to other food containers, expanded polystyrene containers and other expanded foam containers retain heat better and are more environmentally friendly both in manufacture and disposal. Expanded foam containers facilitate embossed graphics and unique design elements such as eye-catching colored foam—elements which increase marketplace identification and add a contemporary look. Integral v-shaped ribs (sometimes also referred to herein as grooves) and corner gussets add structural strength to the container by reducing flexing and warping. Yet, these same v-shaped ribs and corner gussets cooperate with pre-formed creases to enable easy folding of the container for disposal. A fastener retains the folded container in a compact packet for disposal.

Applicant's invention, when made from biodegradable materials such as potato starch and limestone laminates, also improves the character of the garbage being sent to the landfill. Whereas cardboard containers, corrugated containers, and containers made from expanded polystyrene may require decades to decompose, applicant's biodegradable food box decompose much more rapidly.

SUMMARY OF THE INVENTION

Applicant's foldable insulated food box invention provides a lower receptacle section with a flat base and side walls sloping outwardly and upwardly from the flat base to a lower section lip. An upper cover section includes a flat top and side walls sloping outwardly and downwardly from the perimeter of the flat top to an upper section lip which mates with the lower section lip. A hinge connects a portion of the lower section lip to a portion of the upper cover section lip. Integrally formed v-shaped ribs in the flat base and the flat top provide structural strength, and pre-formed creases (or fold lines) facilitate folding of the food box for disposal.

Other objects, features, and advantages of the present invention will become clear from the following description of the preferred embodiment when read in conjunction with the accompanying drawings and appended claims.

DETAILED DESCRIPTION

In the following detailed description, like numerals and characters designate like elements throughout the figures of the drawings.

Figure 1:
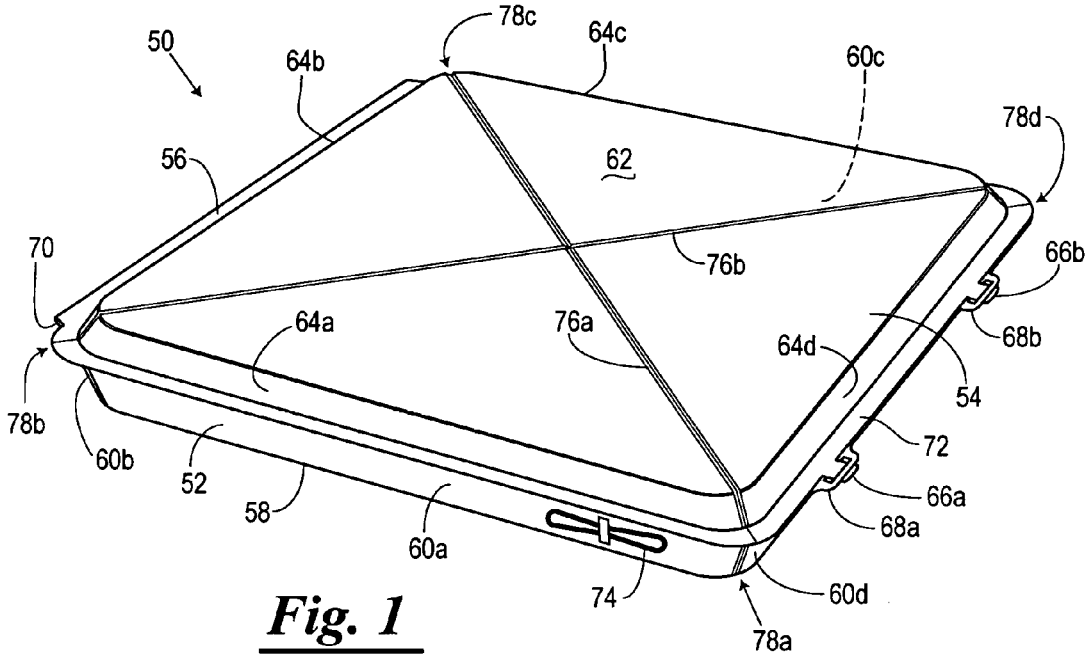
FIG. 1 shows the foldable insulated food box of the present invention.

Referring generally to the drawings and more particularly to FIG. 1, a foldable insulated food box 50 has a lower receptacle section 52 and a similarly-shaped upper cover section 54. The sections 52, 54 are joined by a hinge 56 along rear edges 57, 59, respectively, of the sections 52 and 54. The hinge 56 permits the upper section 54 to close over the lower section 52.

Still referring to FIG. 1, the lower receptacle section 52 has a flat base 58 and upwardly extending walls 60*a*, 60*b*, 60*c*, and 60*d*. The side walls 60*a*, 60*b*, 60*c*, and 60*d* slope outwardly from the perimeter of the base 58 to a lip 70. The upper cover section 54 similarly has a flat top 62 of about the same size as the base 58 and side walls 64*a*, 64*b*, 64*c*, and 64*d* that slope outwardly from the perimeter of the flat top 62 to a lip 72. The lip 70 of the base 58 mates with the lip 72 of the top 62 when the food box 50 is closed. The sloped side walls 60*a*, 60*b*, 60*c*, 60*d*, 64*a*, 64*b*, 64*c* and 64*d* allow for space-saving stacking before use. A fastener 74 attached to the side wall 60*a* prevents the food box 50 from unfolding once it is collapsed (See FIG. 16).

Still referring to FIG. 1, tabs 66*a* and 66*b* formed on the lip 72 of the upper cover section 54 are located at a position opposite the hinge 56 along the lip 72 of the side wall 64*d*. A pair of receivers 68*a* and 68*b* for tabs 66*a* and 66*b*, respectively, are located in the lip 70 of the lower receptacle section 52 so that the tabs 66*a* and 66*b* tuck into the receivers 68*a* and 68*b* to hold keep the food box 50 closed.

Still referring to FIG. 1, a diagonal v-shaped rib 76*a* crosses the food box 50 from corner 78*a* to corner 78*c*. Another diagonal v-shaped rib 76*b* crosses the food box 50 from corner 78*b* to corner 78*d*.

While the food box 50 illustrates a rectangular shape, the food box 50 may assume other shapes such as a square, a circle or an octagon. In addition, the food box 50 is generally constructed from a single sheet of expandable polystyrene foam although other materials could be used instead (See FIG. 17).

Figure 2:
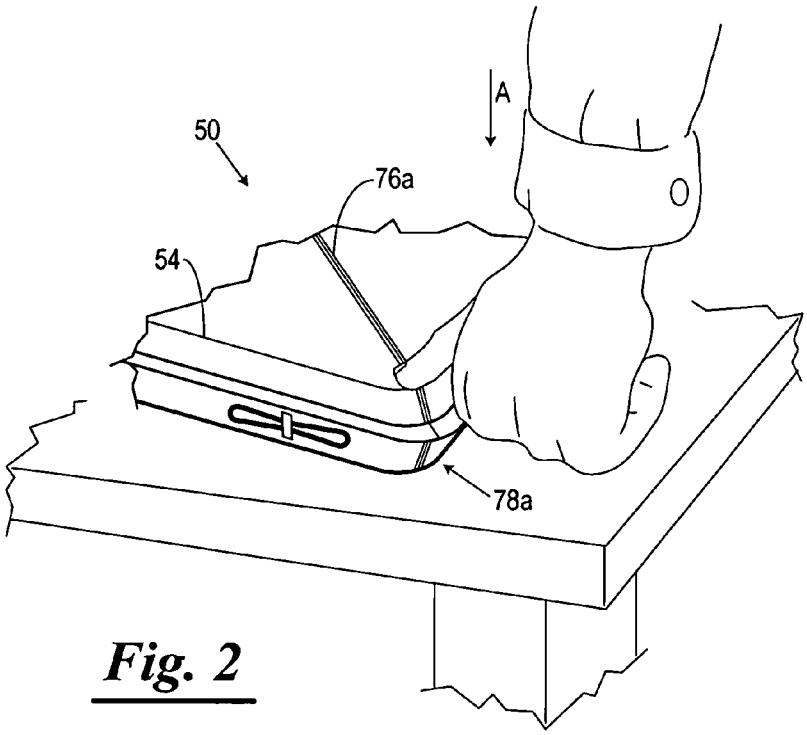
FIG. 2 shows a corner of the foldable insulated food box of FIG. 1 as a human hand flattens the box.

Referring now to FIG. 2, a human hand pressing down on the v-shaped rib 76*a* at the corner 78*a* of the upper cover section 54 of the foldable insulated food box 50 is shown.

Figure 3:
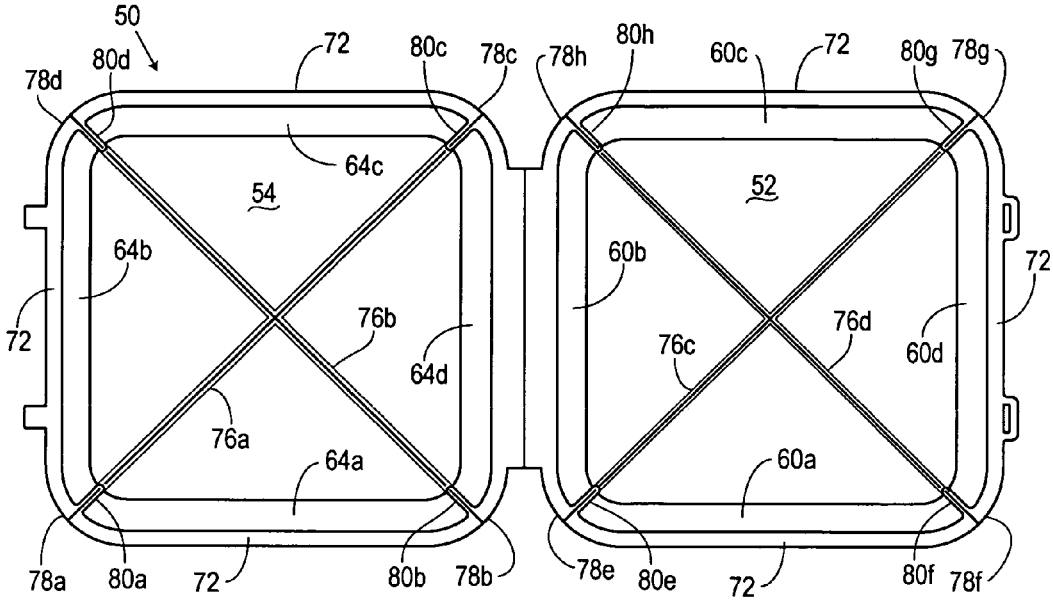
FIG. 3 is a view of the interior of the foldable insulated food box shown in FIGS. 1 and 2 as the foldable insulated food box might arrive from a mold.

Referring now to FIG. 3, a food box 50 in the open position prior to being flattened is shown. A diagonal v-shaped rib 76*c* crosses the lower receptacle section 52 from corner 78*e* to corner 78*g* while another diagonal v-shaped rib 76*d* crosses the lower receptacle section 52 from corner 78*f* to corner 78*h*. Yet another diagonal v-shaped rib 76*a* crosses the upper cover section 54 of the food box 50 from corner 78*a* to corner 78*c*. The diagonal v-shaped rib 76*b* crosses the food box 50 from corner 78*b* to corner 78*d*. In each of the corners 78*a*, 78*b*, 78*c*, 78*d*, 78*e*, 78*f*, 78*g*, and 78*h*, a corresponding gusset (a reinforcing triangular insert) 80*a*, 80*b*, 80*c*, 80*d*, 80*e*, 80*f*, 80*g*, and 80*h* is located.

Figure 4:
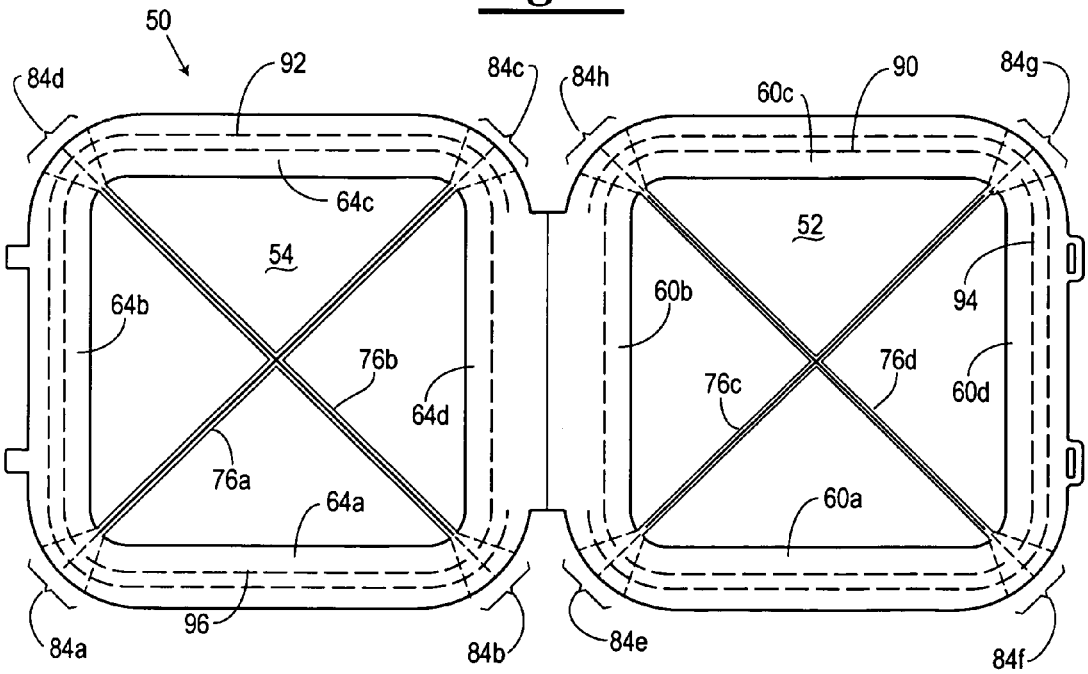
FIG. 4 is a view of the exterior of the foldable insulated food box shown in FIGS. 1 and 2 as the foldable insulated food box might arrive from a mold.

Referring now to FIG. 4, an open food box 50 which has been flattened is shown. The gussets 80*a*, 80*b*, 80*c*, 80*d*, 80*e*, 80*f*, 80*g*, and 80*h* illustrated in FIG. 3 have been flattened into creases (the gusset's former fold lines) 84*a*, 84*b*, 84*c*, 84*d*, 84*e*, 84*f*, 84*g*, and 84*h* at the ends of the diagonal groove creases 76*a*, 76*b*, 76*c*, and 76*d*. Lip creases 90 and 92 are also formed on the lower receptacle section 52 and on the upper cover section 54, respectively, as a result of flattening the food box 50. In addition, a fold line 94 is formed on the side walls 60*a*, 60*b*, 60*c*, and 60*d* of the lower receptacle section 52 when the food box 50 is flattened. Another fold line 96 appears on the side walls 64*a*, 64*b*, 64*c*, and 64*d* of the upper cover section 54 when the food box 50 is flattened.

Figure 5:
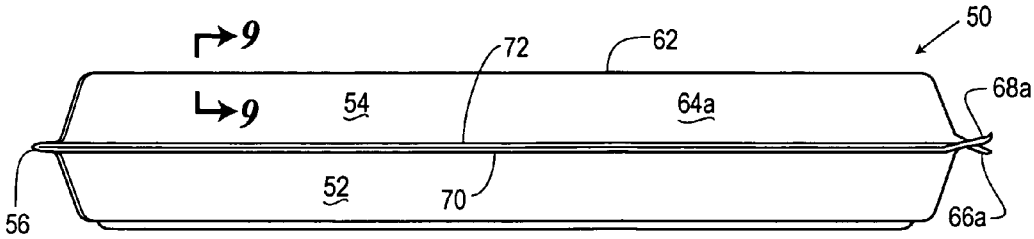
FIG. 5 is another view of the foldable insulated food box of FIGS. 1–4.

Referring now to FIG. 5, another view of the food box 50 is shown. The lip 70 on lower receptacle section 52 and the lip 72 on the upper cover section 54 have been brought together to close the food box 50 by placing the tab 66*a* through the receiver 68*a*. Diametrically opposite the tab 66*a* and the receiver 68*a* is the hinge 56.

Figure 6:
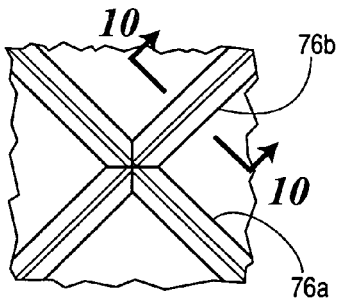
FIG. 6 is a detailed view of the foldable insulated food box of FIGS. 1–5 showing the intersection of diagonal v-shaped ribs (see FIGS. 1–4).

Referring now to FIG. 6, a detailed view of the intersection of the diagonal v-shaped ribs 76*a* and 76*b* illustrated in FIG. 1 is shown.

Figure 7:
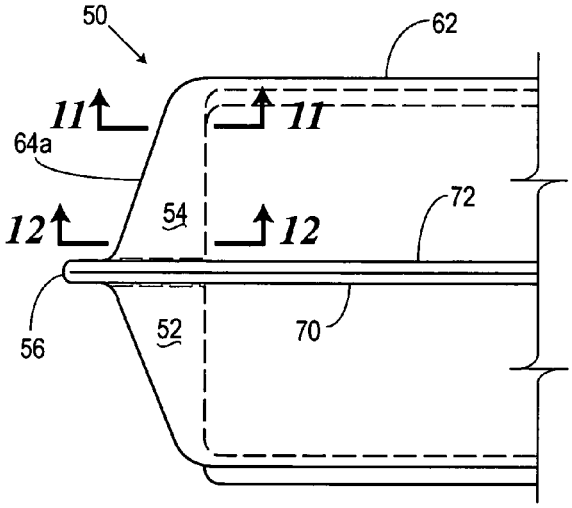
FIG. 7 is a partially cut away detailed view of a hinged corner of the foldable insulated food box of FIGS. 1–6.

Referring now to FIG. 7, the hinge 56 that connects the upper cover section 54 to the lower receptacle section 52 along the periphery of the sections 52 and 54 as illustrated in FIG. 1 is shown. When the food box 50 is closed, the lip 70 on lower receptacle section 52 aligns with the lip 72 on the upper cover section 54.

Figure 8:
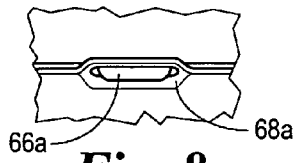
FIG. 8 is a detailed view, partially cut away, of a tab and a receiver (also shown in FIG. 5).

Referring now to FIG. 8, a detailed view of the box closure formed by inserting tab 66*a* through the receiver 68*a* as illustrated in FIG. 5 is shown.

Figure 9:
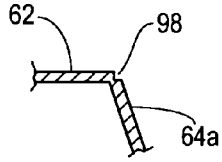
FIG. 9 is a cross-section along 9—9 in FIG. 5.

Referring now to FIG. 9, a joint 98 created where the top 62 of the upper cover section 54 meets the side wall 64*a* of the upper cover section 54 as illustrated in FIG. 5 is shown.

Figure 10:
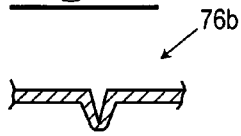
FIG. 10 is a cross-section along 10—10 in FIG. 6.

Referring now to FIG. 10, a cross-section of the v-shaped rib 76*b* as illustrated in FIG. 6 is shown.

Figure 11:
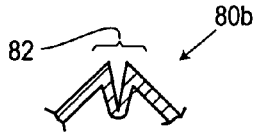
FIG. 11 is a cross-section along 11—11 in FIG. 7.
Figure 12:
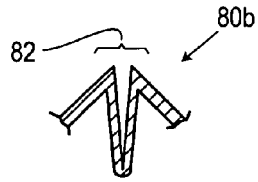
FIG. 12 is a cross-section along 12—12 in FIG. 7.

Referring now to FIGS. 11 and 12, a cross-section of the corner gusset 80*b* as illustrated in FIGS. 3 and 7 is shown. The v-shape 82 of the gusset 80*b* is shallower approaching the top 62 of the upper cover section 54 and deeper approaching the lip 72 of the upper cover section 54 as a result of the sloping side wall 64*a* (See FIGS. 3 and 7).

Figure 13:
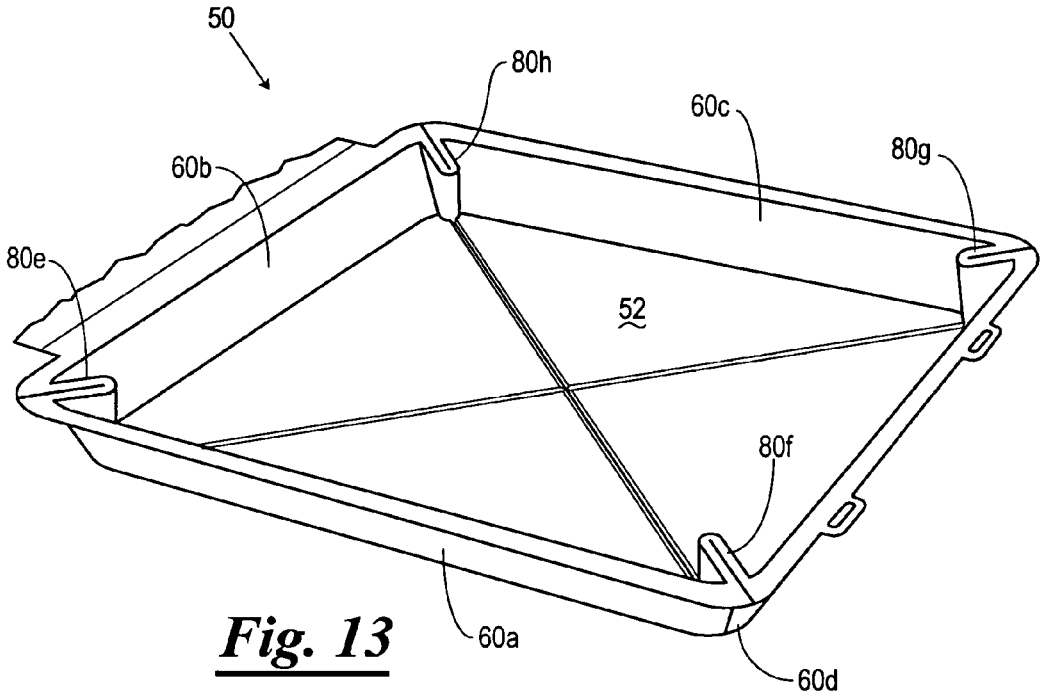
FIG. 13 is a pictorial view of the lower receptacle section of the foldable insulated box of applicant's invention wherein the upper cover section beyond the hinge has been cut away.

Referring now to FIG. 13, four corner gussets 80*e*, 80*f*, 80*g*, and 80*h* extending inwardly from the side walls 60*a*, 60*b*, 60*c*, and 60*d* of the lower receptacle section 52 of the foldable insulated box 50 are shown.

Figure 14:
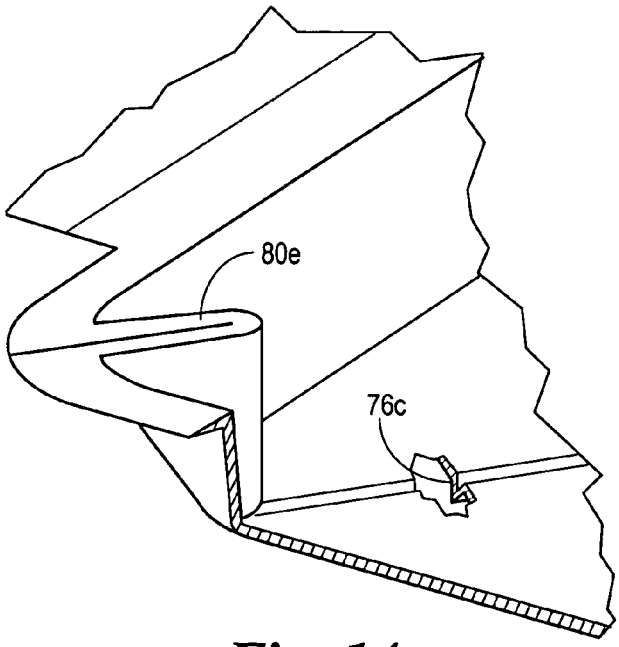
FIG. 14 is a detailed view of a gusseted corner of the lower receptacle section of the foldable insulated food box shown in FIG. 13.

Referring now to FIG. 14, a detailed view of the corner gusset 80*e* illustrated in FIG. 13 is shown. The corner gusset 80*e* is adjacent to the diagonal v-shaped rib 76*c*.

Figure 15:
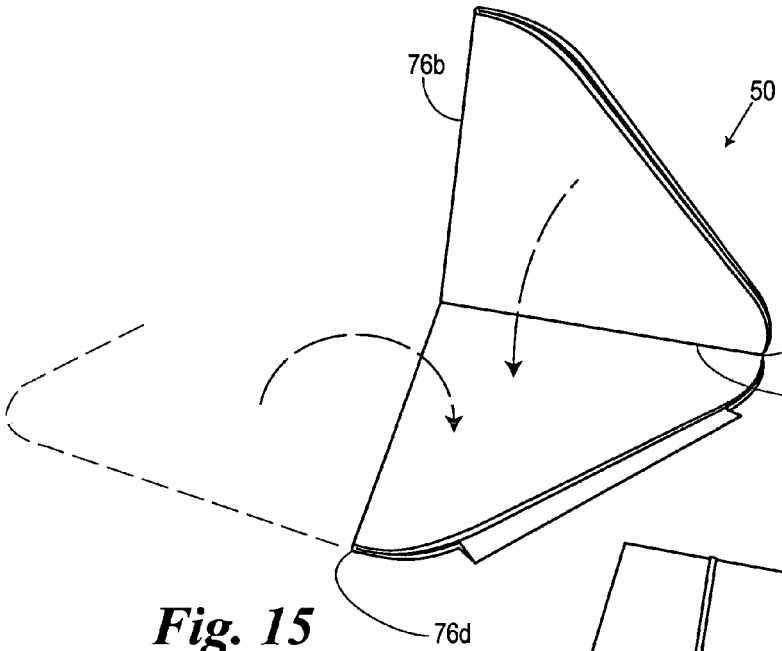
FIG. 15 is a view of the insulated food box of FIGS. 1–14 wherein one half of the collapsed insulated food box, already folded across one of the diagonal v-shaped ribs, is further folded across the second v-shaped rib.

Referring now to FIG. 15, wherein one half of the collapsed insulated food box 50, already folded across the diagonal v-shaped ribs 76*b* and 76*d*, is further folded into quarters across the v-shaped ribs 76*a* and 76*c*.

Figure 16:
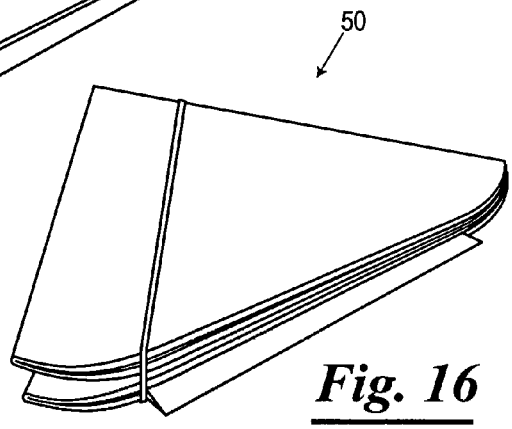
FIG. 16 is a view of the collapsed food box, now folded into roughly one-fourth of its original size, with an elastic band attached to hold the food box in a collapsed and folded state for disposal.

Referring now to FIG. 16, the collapsed food box 50, now folding into roughly one-fourth of its original size, with a fastener (elastic band) 74 attached to hold the food box 50 in a collapsed and folded state for disposal is shown.

Figure 17:
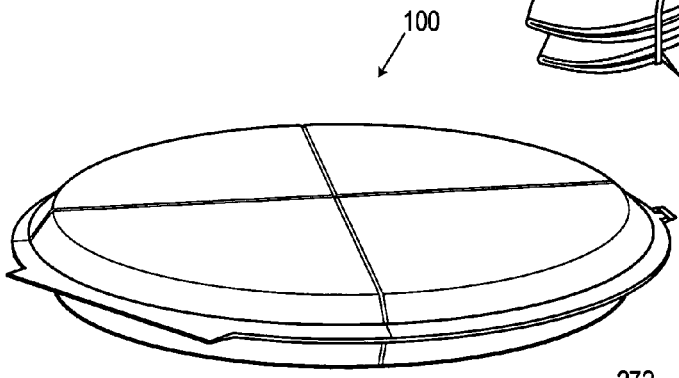
FIG. 17 is a view of another foldable insulated food box according to the present invention.

Referring now to FIG. 17, a circular foldable insulated food box 100 in accordance with the applicant's invention is shown. The circular food box 100 has similar characteristics to the food box 50 illustrated in FIG. 1.

Figure 18:
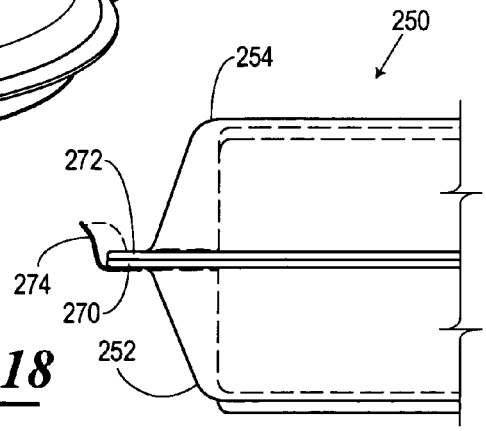
FIG. 18 is a partially cut away detailed view of another foldable insulated food box according to applicant's invention.

Referring now to FIG. 18, another foldable insulated food box 250 includes a lower receptacle section 252 having a lip 270 and an upper cover section 254 having a lip 272. A fastener 274 attaches to the upper lip 272 and the lower lip 270 to create a hinge so that the upper cover section 254 can be opened for access to the lower receptacle section 252. The fastener 274 shown in FIG. 18 is a strip of adhesive material extending along the lips 270, 272 of the sections 252, 254, respectively.

Figure 19:
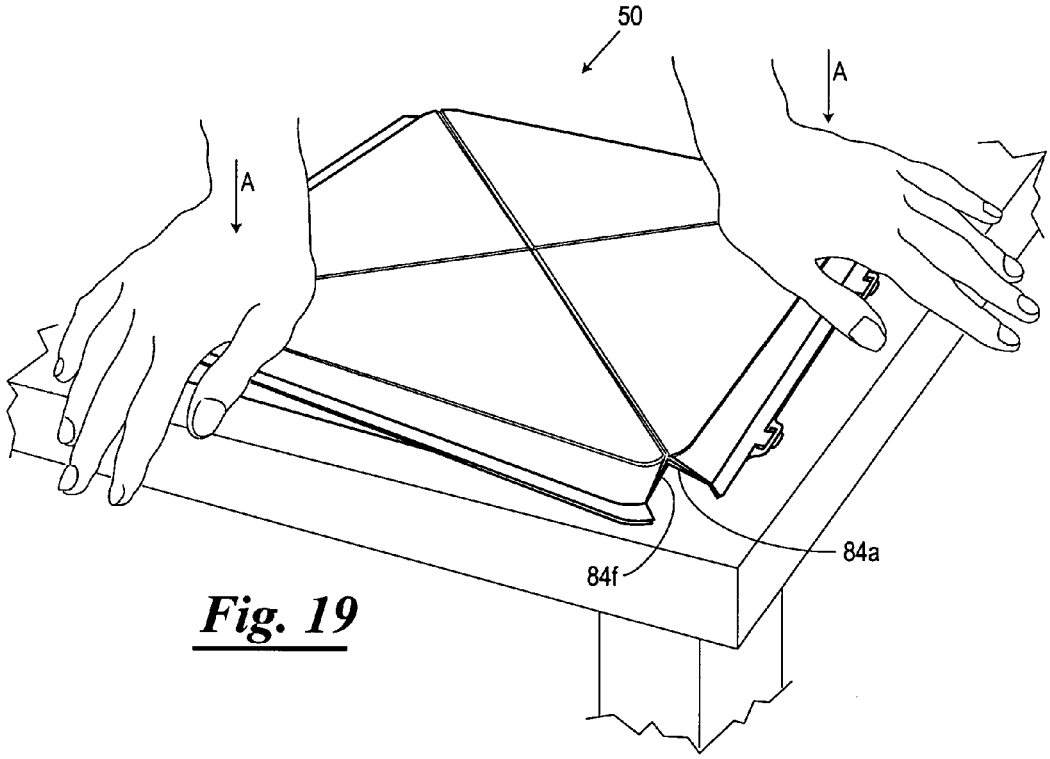
FIG. 19 shows the foldable insulated food box separated at a corner while the box is being flattened by a pair of human hands.

Referring now to FIG. 19, the foldable insulated food box 50 being flattened by a pair of human hands. As force exerted along A, the food box 50 breaks apart at the corners as illustrated by the separation of creases 84*a* and 84*f* as the box 50 is flattened.

Figure 20:
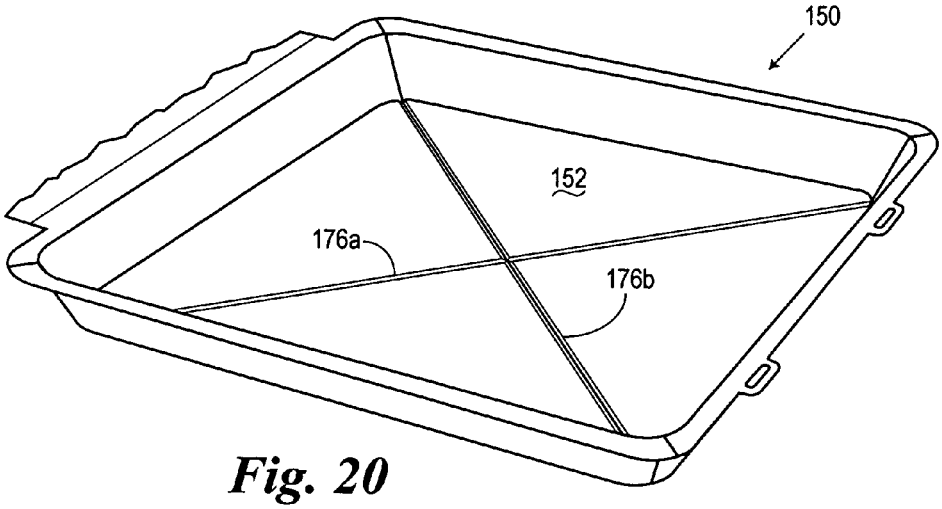
FIG. 20 is a pictorial view of the lower receptacle section of the foldable insulated food box according to applicant's invention.
Figure 21:
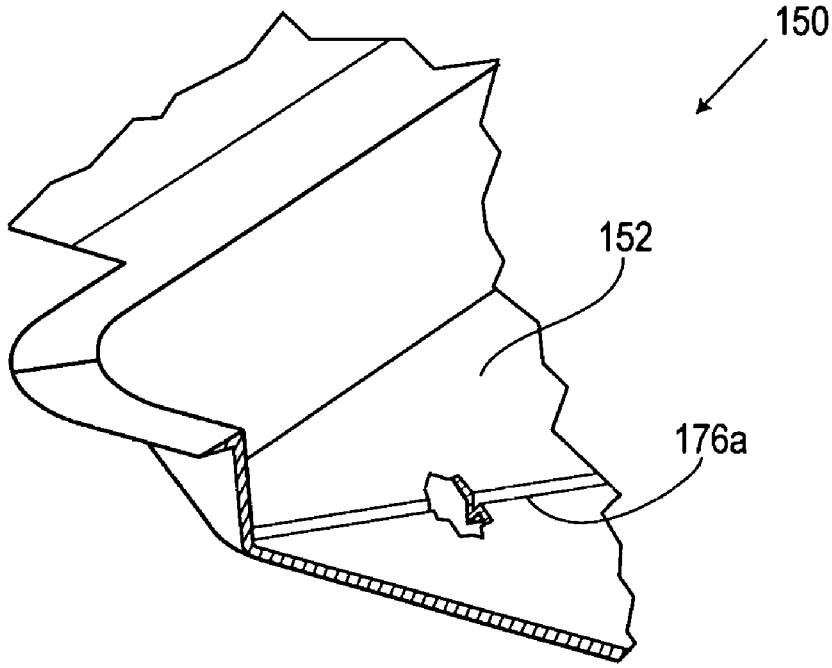
FIG. 21 is a detailed view of a corner of the foldable insulated food box shown in FIG. 20.

Referring now to FIGS. 20 and 21, another foldable insulated food box 150 is shown. A lower receptacle section 152 of the food box 150 contains v-shaped ribs 176*a* and 176*b* but omits the corner gussets 80*a*, 80*b*, 80*c*, 80*d*, 80*e*, 80*f*, 80*g*, and 80*h* shown in FIG. 3.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A foldable insulated food box comprising:

a lower receptacle section having a flat base and side walls sloping outwardly from the perimeter of the flat base to a lower section lip;

an upper cover section having a flat top and side walls sloping outwardly from the perimeter of the flat top to an upper section lip;

a hinge connecting a portion of the lower section lip to a portion of the upper section lip so that the upper cover section pivots between a closed position wherein the upper cover section cooperates with the lower receptacle section to form a closed container and an open position wherein the upper cover section folds away from the lower section along the hinge to permit access to the contents of the lower receptacle section;

at least one diagonal v-shaped rib in the flat base; and at least one diagonal v-shaped rib in the flat top, wherein the flat base diagonal v-shaped rib is generally aligned with the flat top diagonal v-shaped rib, so that, when the upper cover section is in the closed position the upper cover section and the lower receptacle section can be folded simultaneously along the generally aligned v-shaped ribs to create a relatively smaller configuration for disposal.

2. The device of claim 1, further comprising:

a second diagonal v-shaped rib in the flat top.

3. The device of claim 2, further comprising:

a second diagonal v-shaped rib in the flat base.

4. The device of claim 1, further comprising:

a fastener attached to a lower receptacle section side wall for retaining the folded food box in the relatively smaller configuration for disposal.

5. The device of claim 1, wherein the flat bottom of the lower receptacle section is rectangular and cooperates with the lower receptacle section sloping side walls to form a generally rectangular lower receptacle section having four lower receptacle section corners, wherein the flat top of the upper cover section is rectangular and cooperates with the upper cover section sloping side walls to form a generally rectangular upper cover section having four upper cover section corners, and wherein the generally rectangular upper cover section cooperates with the generally rectangular lower receptacle section to form a generally rectangular foldable disposable food box with mating lower section sloping side walls and upper section sloping side walls.

6. The device of claim 5, further comprising:

a gusset in each corner of the generally rectangular lower receptacle section; and a gusset in each corner of the generally rectangular upper cover section.

7. The device of claim 1, wherein the flat bottom in the lower receptacle section is generally circular and the flat top in the upper receptacle section is generally circular, so that the lower receptacle section and the upper receptacle section cooperate to form a generally circular food box.

8. The device of claim 1, wherein the lower receptacle section, the upper cover section, and the hinge are formed from a single sheet of expanded foam.

9. The device of claim 1, wherein the hinge further comprises adhesive material commonly attached to a portion of the lower receptacle section and a portion of the upper cover section.

10. The device of claim 1, wherein the upper cover section includes at least one tab opposite the hinge, the lower receptacle section includes at least on tab receiver opposite the hinge, and the tab is received in the tab receiver when the upper cover section is aligned with the lower receptacle section in the closed position.

11. The device of claim 5, wherein the lower receptacle section includes a pre-formed crease along each side of the generally rectangular flat bottom and the upper cover section includes a pre-formed crease along each side of the generally rectangular top, so that a downward force applied to each corner of the closed food box results in a flattening of the upper cover section and a flattening of the lower receptacle section for compact disposal of the closed food box.

12. The device of claim 3, wherein the upper cover section includes at least one tab opposite the hinge, the lower receptacle section includes at least on tab receiver opposite the hinge, and the tab is received in the tab receiver when the upper cover section is aligned with the lower receptacle section in the closed position.

13. The device of claim 8, wherein the upper cover section includes at least one tab opposite the hinge, the lower receptacle section includes at least on tab receiver opposite the hinge, and the tab is received in the tab receiver when the upper cover section is aligned with the lower receptacle section in the closed position.

14. The device of claim 9, wherein the upper cover section includes at least one tab opposite the hinge, the lower receptacle section includes at least on tab receiver opposite the hinge, and the tab is received in the tab receiver when the upper cover section is aligned with the lower receptacle section in the closed position.

* * * * *